United States Patent [19]

Battigelli et al.

[11] Patent Number: 4,487,622

[45] Date of Patent: Dec. 11, 1984

[54] METHOD AND APPARATUS FOR FORMING FIBER WEBS

[75] Inventors: Jean A. Battigelli, Rantigny; Guy Berthier, Clermont, both of France

[73] Assignee: Isover Saint-Gobain, Paris la Défense, France

[21] Appl. No.: 453,733

[22] Filed: Dec. 27, 1982

[30] Foreign Application Priority Data

Dec. 28, 1981 [FR] France ..... 81 24318

[51] Int. Cl.[3] ..... C03B 37/06

[52] U.S. Cl. ..... 65/4.4; 65/5; 65/9; 65/16

[58] Field of Search ..... 65/4.4, 9, 5, 16; 156/62.4

[56] References Cited

U.S. PATENT DOCUMENTS

| | | | |
|---|---|---|---|
| 3,445,207 | 5/1969 | Goerens | 65/9 |
| 3,746,524 | 7/1973 | Kirchheim | 65/6 |
| 3,787,195 | 1/1974 | Kirchheim | 65/9 |

FOREIGN PATENT DOCUMENTS

| | | | |
|---|---|---|---|
| 200747 | 8/1967 | U.S.S.R. | 65/4.4 |

*Primary Examiner*—Robert Lindsay

*Attorney, Agent, or Firm*—John T. Synnestvedt; Kenneth P. Synnestvedt

[57] ABSTRACT

The invention concerns the improvement of the fiber distribution in a web or mat, the attenuation of the fibers being effected by means of gas currents.

The material delivered in the form of filaments is attenuated in a channel between two gas jets. At the outlet of the channel, the gas current carrying the fibers entrains the ambient air and passes through a guide apparatus containing two walls. The circulation of the air induced between the channel and the guide apparatus is modified by the interposition of baffles.

The modification provides for improvement in the uniformity in the fiber web being made.

7 Claims, 15 Drawing Figures

METHOD AND APPARATUS FOR FORMING FIBER WEBS

The invention is relative to the production of a web of fibers by attenuation of thermoplastic materials by means of gas currents.

In the techniques considered the material in the molten state is passed through a bushing. The filaments delivered by the bushing are entrained and attenuated between two substantially parallel gas currents. These currents are directed in the direction of flow of the filaments on both sides of the flow path. The emission of the gas currents and the attenuation of the filaments are effected in a confined area, mainly defined by two walls forming a channel.

The fibers formed are transported by the gas currents and are directed toward a receiving member comprising a gas-permeable conveyor belt. The fibers are retained on the conveyor belt. The movement of the conveyor belt results in the formation of a continuous web or mat of fibers of small thickness.

One of the greatest difficulties of this type process is the attainment of a uniform distribution of the fibers over the surface of the receiving member, such uniform distribution being necessary in order for the product to have uniform properties throughout.

French Pat. No. 2,085,525 and its Addition No. 2,108,162, belonging to the Applicant, each describe certain means for improving fiber distribution. Disclosure of this type is also present in the U.S. Pat. No. 3,746,524, corresponding to those French patents.

The main French patent referred to presents, in particular, systems for adjusting the spacing of the walls confining the gas currents during the attenuation stage. To a certain degree the differences in spacing of the walls, also called the "skirt", enable modification of the flow of the attenuating gas and, consequently, the flow of the fibers being formed. These modifications made at the level of the fiberizing assembly are continued up to the receiving member.

When the width of the channel between the two walls in the attenuating stage is reduced, the quantity of fibers on the portion of the corresponding receiving member is decreased and when the channel is increased the quantity of fibers is increased.

The French Patent of Addition referred to concerns the spreading out of the fiber flow on wide conveyor belts. For this purpose, the gas flow issuing from the attenuation member is guided through an assembly called a guide apparatus. A relatively wide space is provided between the attenuation member and the guide apparatus to enable the entrainment of a large quantity of ambient air.

The guide apparatus is essentially formed by two flat walls between which the gas currents flow. The space between the walls decreases when getting closer to the receiving member, thus allowing only a relatively narrow opening to exist at this level. This narrowing of the opening is compensated for by the spreading out of the flow over a wide path.

As for the skirt of the attenuation apparatus, the spacing of the walls of the attenuating skirt is adjustable and, at the same level, different distances can be established locally to increase or reduce the gas flow.

The arrangements contemplated in these two prior French patents result in a good general distribution. Instead of a deposit of fibers highly concentrated at the center of the conveyor belt, with sides practically devoid of fibers, a layer is attained covering the entire width and is spread out in a relatively uniform manner.

However, the operation over long periods of the assemblies such as those described above show that the initial uniformity of the fiber webs can be significantly disturbed as a result of difficultly controllable incidents, such as, for example, the deformation or wear of the fiberizing bushing, or even the blockage of orifices of the bushing. These localized modifications are difficult to compensate by the arrangements previously described.

Therefore, it appears desirable to provide means suitable for re-establishing a substantially uniform distribution of the fibers even when difficultly controllable incidents occur. This is the main object of the invention. One object of the invention in particular is to provide means which enable highly localized modification of the distribution.

Furthermore, it is highly desirable for the means utilized for this purpose to be relatively simple to implement and to have no effect on the fiber attenuation process, which should respond to extremely precise conditions, as even slight modification of these conditions can cause significant disruption of the operation of the overall assembly.

With the improved arrangement, it is possible to alter the distribution of the fibers in the web or mat formed in a localized and relatively precise manner by intervention on those gas currents which are induced but which are not being relied upon for attenuation of the fibers. These gas currents are those which are combined with the attenuating gases after the latter are discharged from the attenuating apparatus.

Most, if not all, of the gas currents in question are formed by the ambient air induced by the attenuating gases. For simplification, they will hereafter be referred to as induced currents, although other gas currents are also induced in the system, which are not part of those to which the invention directly relates. In particular, the invention does not concern the gases aspirated above the attenuating apparatus and, as was stated, the modification of which would affect not only the distribution of the fibers but also their attenuation.

The studies made by the inventors show the quantitative importance of the induced gases. Their volume is ordinarily at least five times that of the attenuating gases. This importance explains that they intervene considerably in the transport and fiber distribution processes.

A first effect of the induced gases is the slowdown of the fibers. At the outlet of the attenuating skirt the attenuating gases are still at very high speed. The entrainment of ambient air considerably decreases the speed of the composite flow. This decrease is necessary, because the projection of the fibers onto the receiving member at the speeds of the attenuating gases would cause the fibers to break, thus undesirably reducing the mechanical properties of the web.

The induction of air enables the reduction of the speed to values of on the order of a few meters per second. Under these conditions the impact of the fibers on the receiving belt is accomplished without damage.

Another effect of these induced gases is the increase in the volume of the gas transporting the fibers, which enables a more convenient distribution over webs or mats of large widths.

In the systems considered the induction of the ambient air is mainly effected in the zone located between the attenuating skirt and the top portion of the guide apparatus. In the prior patents cited it is contemplated to multiply the zones of air induction by arranging openings at different levels of the guide apparatus walls. However, the induction at these levels is substantially lower. In the most recent practice, the guide apparatus is arranged to provide for the passage of induced air primarily at its top portion and to a lesser degree on its sides.

In the traditional apparatus, the arrangement of the various elements of the installation leads to a homogeneous flow of the induced gases all around the attenuating gases. The invention consists of locally modifying the flow of the induced gases which are combined with the attenuating gases. This modification is undertaken in the zone where the induced currents are the most intense, that is, between the attenuating skirt and the guide apparatus.

To modify the normal operation of the induced gases, it is convenient, according to the invention, to make use of members or baffles which oppose the entry of the induced gases in limited or local zones.

The invention is described in detail following the description in which reference is made to the attached sheets of drawings. In these drawings.

Figure 5A:
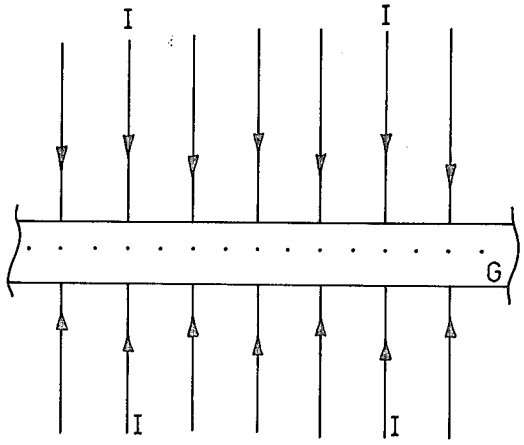
Figure 5B:
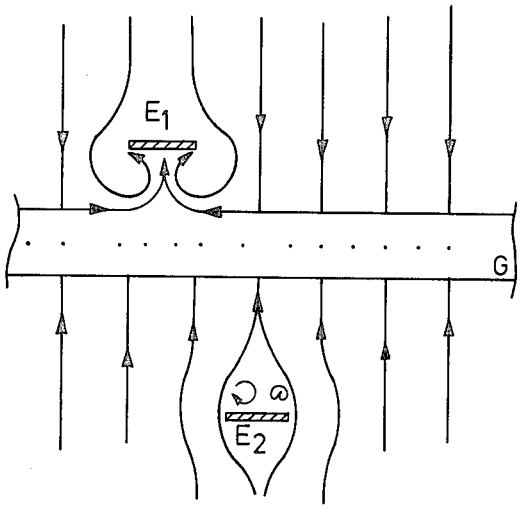
Figure 5C:
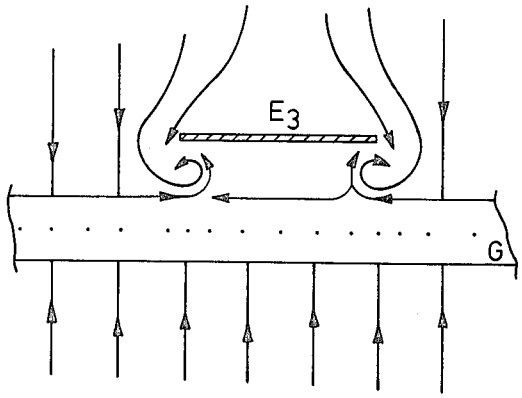
Figure 6:
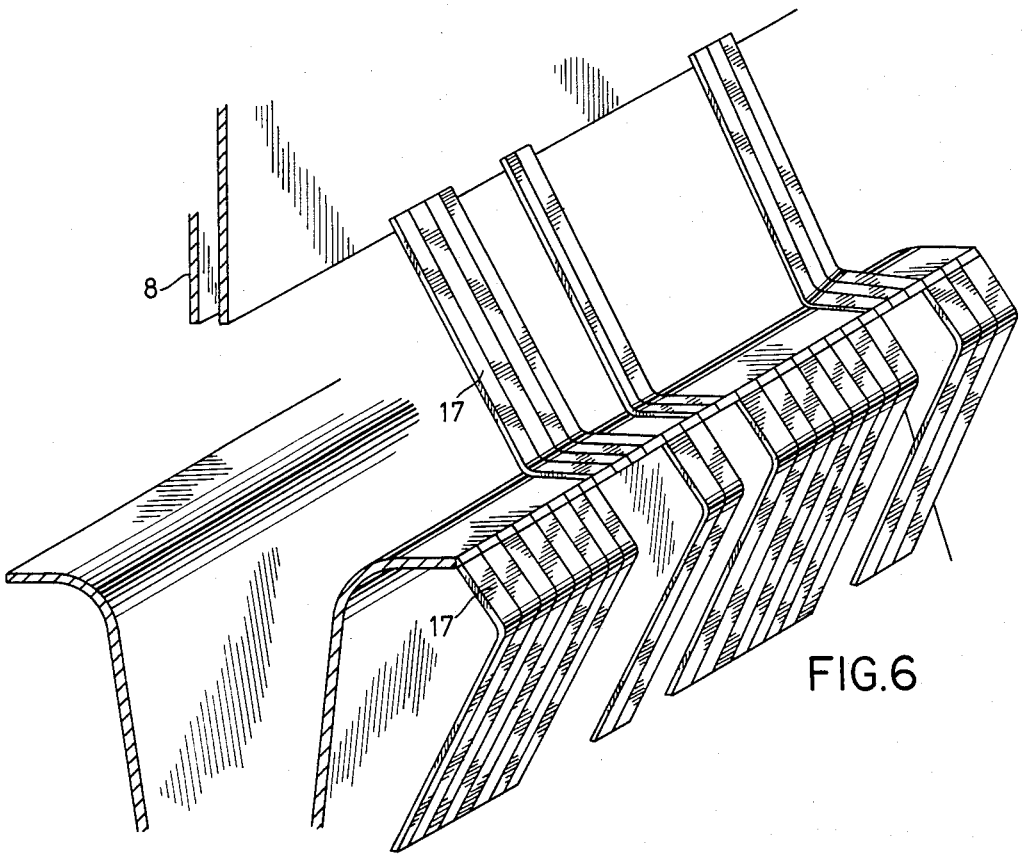
Figure 7:
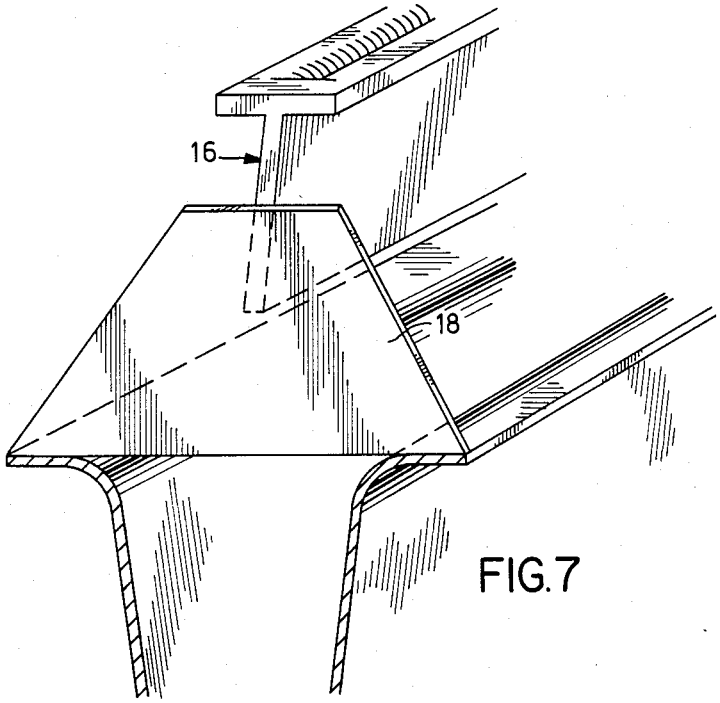
Figure 8A:
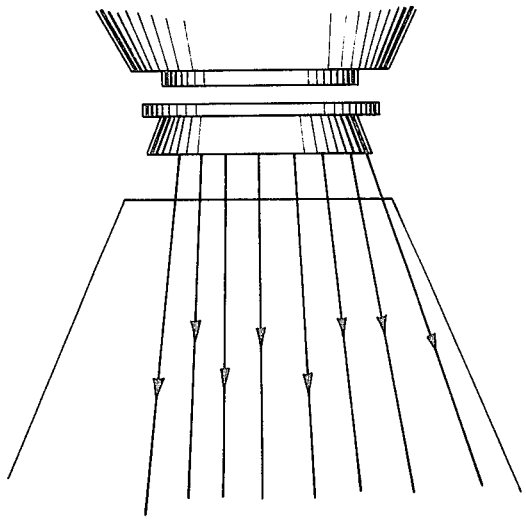
Figure 8B:
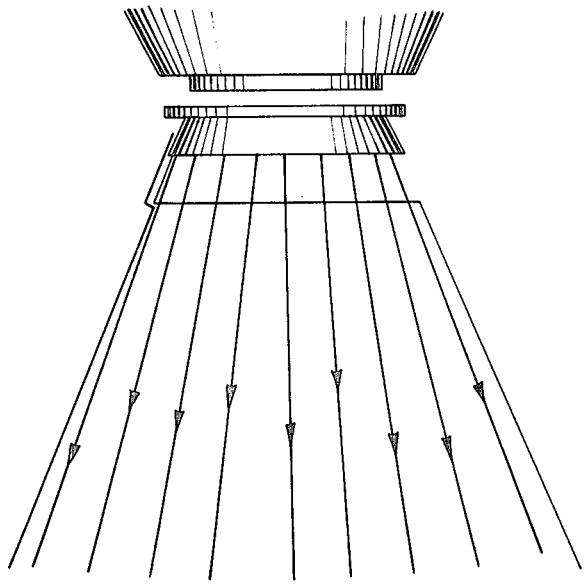

FIGS. 5*a* to 5*c* are diagrams of the current lines of the induced gases in a transversal plane to the direction of the attenuating gases at the level located between the skirt and the guide apparatus;

FIG. 6 is a diagram showing another embodiment of the invention;

FIG. 7 shows the embodiment of a member according to the invention for modifying the induced currents at an end of the attenuating apparatus;

FIGS. 8*a* and 8*b* show the effect of the embodiment of FIG. 6 on the trajectory of the gases in the guide apparatus; and FIGS. 9*a* to 9*d* graphically show the results obtained on the fiber distribution in various tests utilizing the means according to the invention.

In the following description, reference is made specifically to the production of webs or mats of glass fibers. However, it is to be understood that the invention is applicable, regardless of the nature of the material making up the fibers. The characteristics of the invention are independent of the material used.

Figure 1:
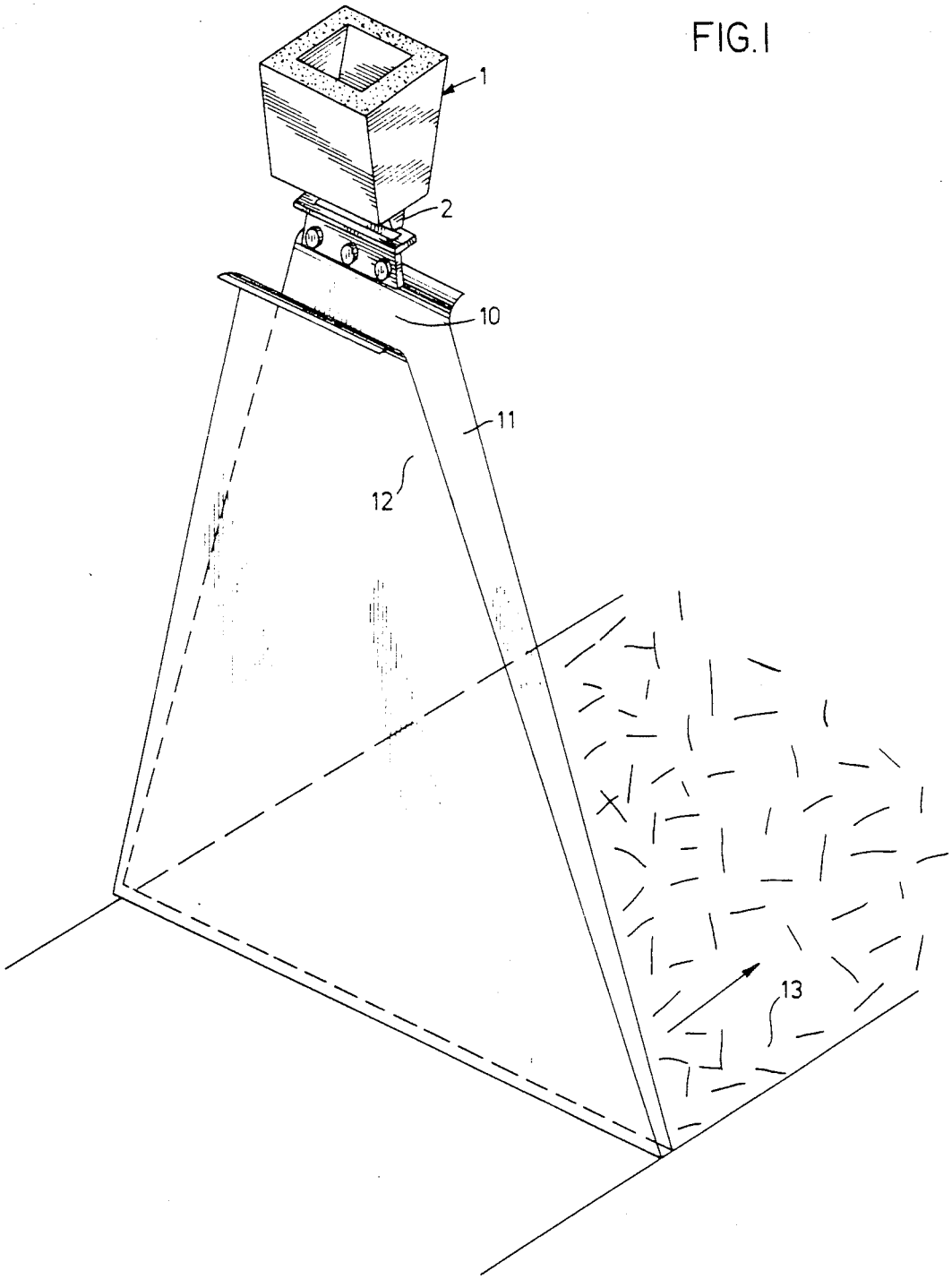
FIG. 1 is a schematic perspective view presenting the main members of the apparatus for forming a fiber web or mat and their relative positions.
Figure 2:
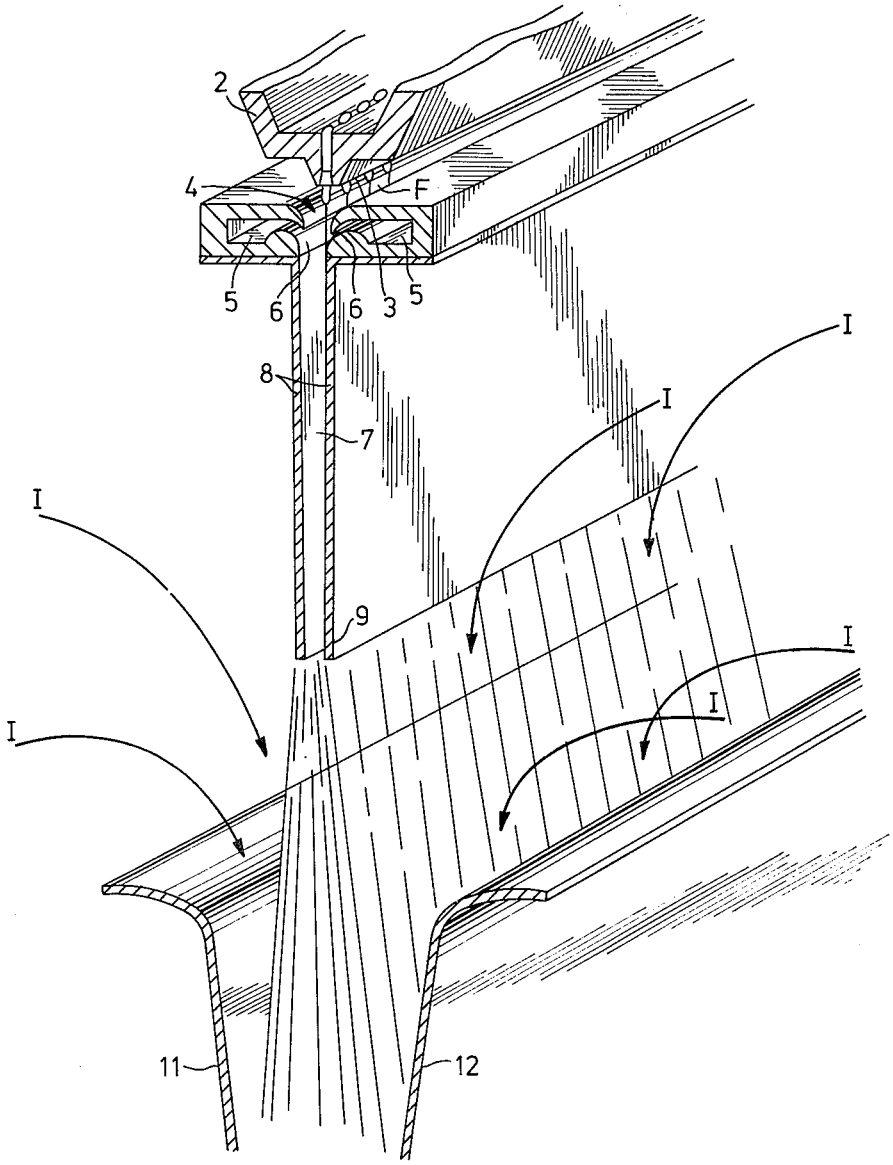
FIG. 2 is a sectional perspective view on a larger scale of the attenuating apparatus and the top portion of the guide apparatus shown in FIG. 1.

FIGS. 1 and 2 show a conventional production unit for making a web of glass fibers.

Ordinarily, the glass comes from a melting furnace, and is conducted through a fore hearth 1 at the bottom of which a bushing 2 is placed.

In other types of installations, the glass is melted directly in a vessel resembling a forehearth.

The bushing 2 is provided with one or several rows of orifices such as shown in FIG. 2 from which glass streams 3 are delivered, the filaments being formed from the streams 3.

An attenuating apparatus is located under the bushing, containing a blower assembly extended by a skirt. The blower assembly has two symmetrical parts each containing a small channel 5 which conducts the gas under pressure used in the attenuation. This gas is ordinarily compressed air or vapor.

The attenuating gas escapes through the lips 6. In the embodiment shown in FIG. 2, the lips of the blower apparatus form a continuous slot on the entire length. In other known forms of equipment these slots are replaced by series of very closely arranged orifices. In both cases the blower apparatus produces two practically continuous gas layers directed downwardly.

The filaments of glass F are drawn from the streams 3 and pass through the opening 4 of the attenuating apparatus. The gases blown from the lips 6 aspirate the ambient air through the opening 4. This current of aspirated air entrains the glass filaments passing downwardly through the opening 4.

The high-speed flow of the gases emitted by the blower on each side of the glass filaments exerts an intense traction effect on the filaments from which the fiber attenuation results.

The speed of the gas remains quite high throughout the channel 7 formed by the two walls 8. The length of the skirt is selected so that it corresponds approximately to the attenuating stage. A shorter length would result in a rapid abatement of the gases and in a slightly less effective attenuation. Reciprocally, a longer skirt could be harmful to the quality of the fibers by increasing the risks of impact on the walls 8.

FIG. 1 schematically indicates three rotatable knurled elements of known type for regulating the spacing of the walls of the attenuating apparatus. Except for the adjustments effected by means of these elements, the walls of the attenuating skirt are substantially parallel.

The gases and the fibers proceeding from the attenuating apparatus are directed toward the guide apparatus formed mainly by the two walls 11 and 12. The latter are flat with the exception of the curved top portion to facilitate the guiding of the induced gases.

The walls 11 and 12 widen and come closer together toward the bottom. Their width at the top is practically that of the attenuating apparatus whereas at the bottom the width corresponds closely to the width of the conveyor belt schematisized at 13.

The means for adjusting the spacing of the walls 11 and 12 are not shown.

On FIG. 1, the sides of the guide apparatus are open. This arrangement seems preferable. When the sides are closed, in effect a certain instability of the gas layer in the guide apparatus is observed. The layer has a tendency to be moved transversely from one side to the other. The sides being open, no surface effect is developed on these sides and the layer remains stable.

On the industrial production lines, several assemblies such as represented in FIG. 1 succeed one another along the conveyor belt to enable a greater speed of production.

From their exit from the attenuating skirt, the attenuating gases induce the ambient air. The current lines of the induced gases are indicated by arrows I on FIG. 2. Of course, the air is also induced on the sides of the guide assembly, but most of it penetrates into the open top portion 10 (FIG. 1). Therefore, the attenuating gases have the highest impetus in this zone. Since the induction is dependent on the impetus of the inductor gas, it is also in this zone that the most intense induction develops. Therefore, it is desirable to arrange the means according to the invention for modifying the induced currents between the skirt and the guide apparatus.

The principle of the invention rests on the fact that a modification of the induced currents upstream of the guide apparatus is translated into a modification of the characteristics of the gas flowing in the guide apparatus and finally at the level of the conveyor belt in the web of fibers being deposited.

Figure 3:
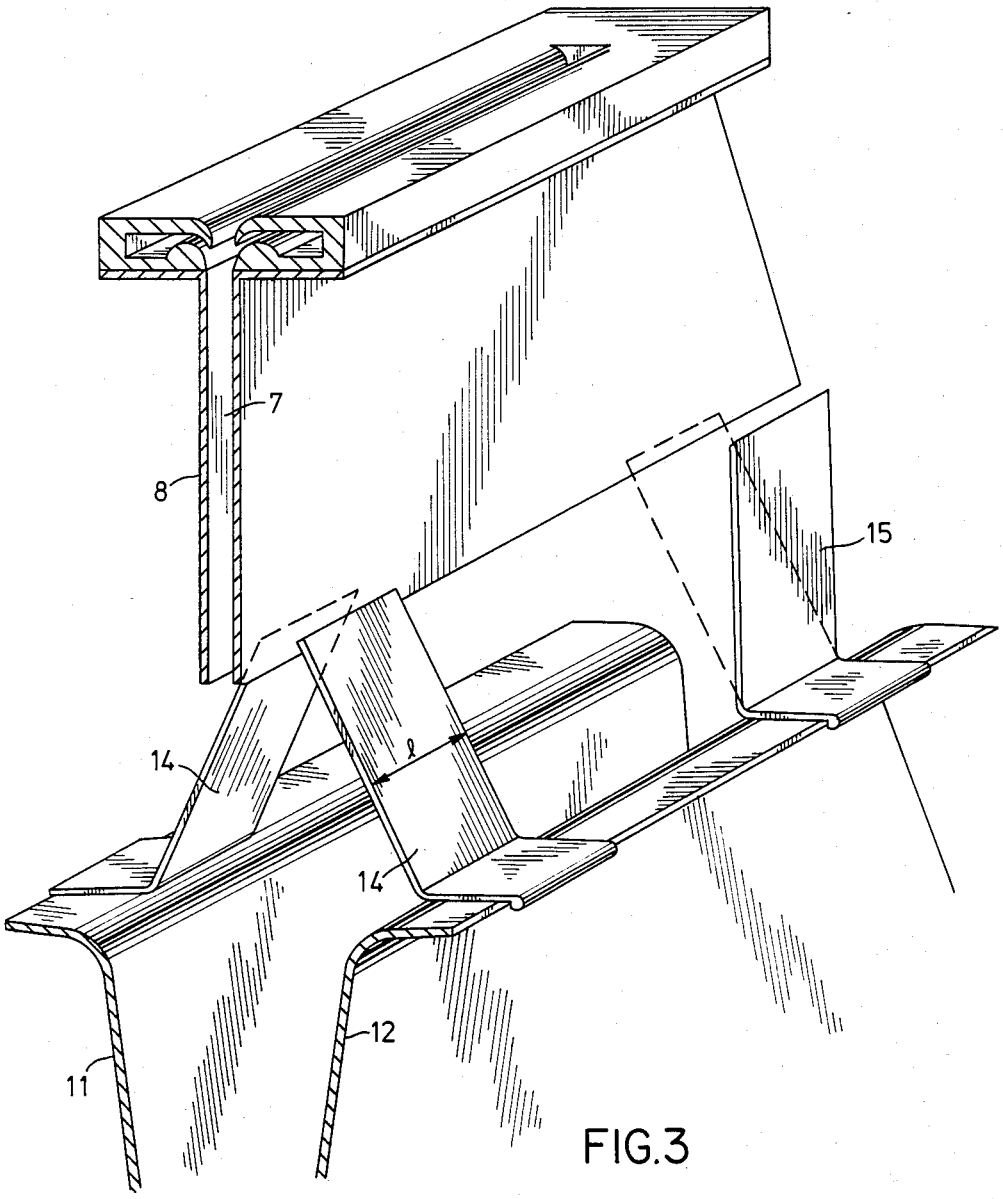
FIG. 3 is a view similar to FIG. 2 on which several means according to the invention are shown for the modification of the fiber distribution.

A preferred embodiment for implementing the invention is represented in FIG. 3. Individual shields or baffles 14 are placed between the skirt of the attenuating apparatus and one wall of the guide apparatus, locally forming an obstacle to the entrance of induced air.

It is important to emphasize that the baffles do not directly modify the gas current carrying the fibers. In this way, any shock, which would be harmful to the fiber quality, is avoided.

In general, without taking into account variations which will be considered later and which depend particularly on the dimension of the baffles, the presence of these baffles results in an increase in the fiber density in the corresponding gas current, an increase which is maintained to the conveyor belt.

From this, the manner of utilization of these baffles follows. When, in the web produced, there is a continued, insufficient local fiber density, one or several baffles are placed in the corresponding position between the skirt and the guide apparatus. The manner of propagation of the gas currents in the apparatus considered enables the position of the baffle to be approximately determined, i.e., by similarity to that of the defect to be corrected.

If the modification of the induced currents by the means just described is a well-established fact in the same manner as the effects of this modification on the density of the fibers, the mechanism which would enable this result to be explained is not precisely understood.

For example, it might be thought that the baffle(s), while preventing a certain dilution of the gas flow carrying the fibers through the induced air, favor(s) an increase in density in the corresponding gas flow. This effect, even if it exists, is unable to account for all the results. We will see in particular in the description of the tests that when the width of the baffle exceeds a certain threshold, the effect obtained is split into two parts. An increase in the fiber density occurs at each border of the baffle.

Figure 4:
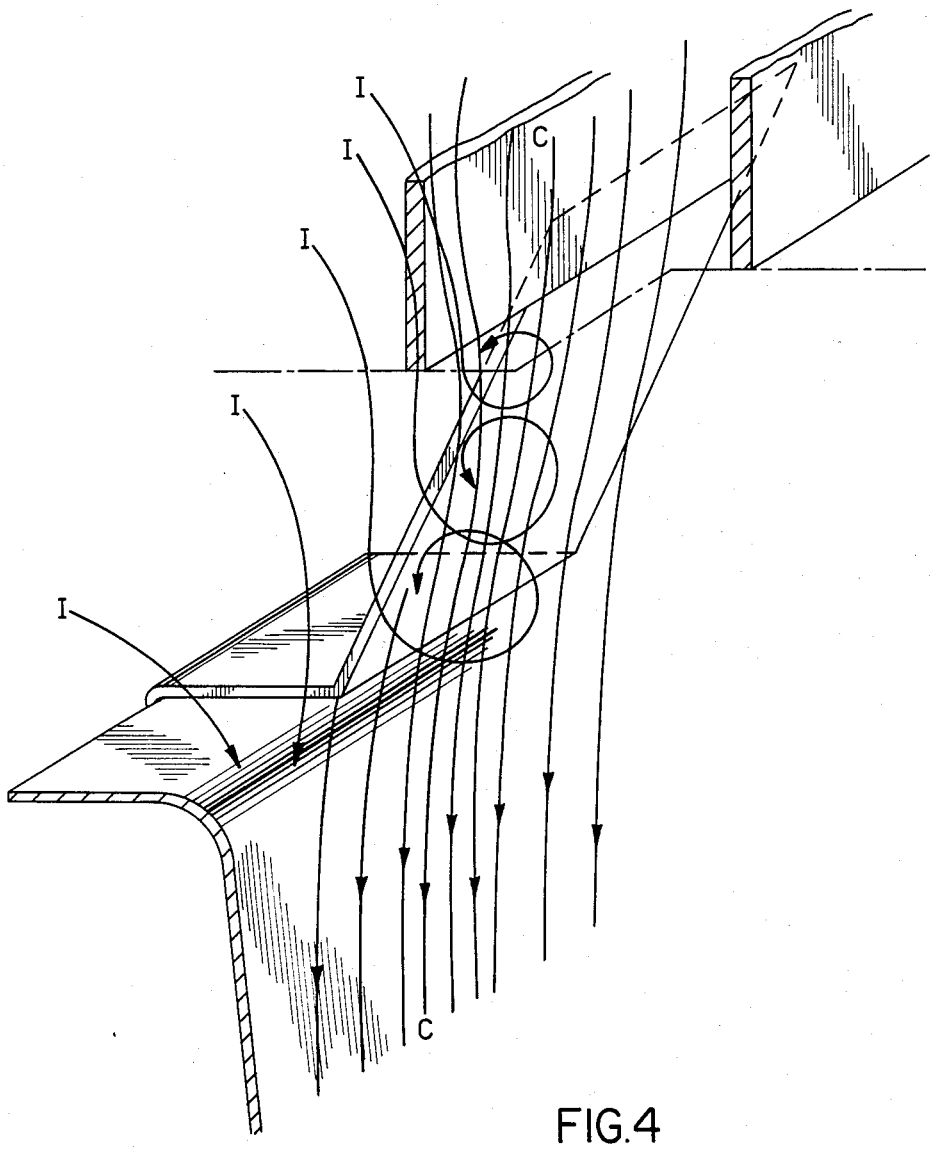
FIG. 4 is a diagram showing the path of the gas currents in one embodiment of the invention.

This border effect possibly arises from whirling movements which develop on the inner edge of the baffle in the manner represented in FIG. 4 and in FIGS. 5*b* and 5*c*.

In FIG. 4, the induced gases I run along the border of the baffle, and are rolled while forming an eddy which entrains the parts of the closest attenuating gas current, which may be located behind the baffle. On the figure, this is represented by a tightening of the current lines C in the turbulent zone. For a baffle of sufficiently narrow width, the effects of the two baffle borders are mixed.

This hypothetical mechanism is specified in FIGS. 5*a* to 5*c*.

The diagram of these figures represents a section of the attenuating gas current G between the skirt and the guide apparatus. This current is represented by its borders. The points located at regular intervals (FIG. 5*a*) between these two borders show the fiber distribution in the current G. The induced currents are represented by the regularly spaced current lines I.

FIG. 5*a* shows the form of the current lines as they can develop in the absence of a baffle. These lines are regular and are directed toward the gas layer G.

FIG. 5*b* shows the modifications introduced in the presence of a baffle of narrow width placed in proximity to the current G (baffle $E_1$) and at a distance from this current (baffle $E_2$). FIG. 5*c* shows the modification caused by a baffle of wide width $E_3$.

The apparent effects in these various cases are the following. The induced currents form eddies, downstream of the baffle, as represented in FIG. 4. When the baffle ($E_1$) is close enough to the gas current G, these eddies entrain a fraction of the latter. The baffle in some way aspirates a portion of the attenuating gas. A tightening of the fibers results in a portion of the current G being located behind the baffle. The induction is "reversed".

If the baffle ($E_2$) is separated from the gas current, a similar effect is produced in the induced currents; however, on the one hand, the intensity and the definition of the induced currents are weaker when they are further from the inductor current and the eddies resulting from the border effect are, therefore, smaller, and on the other hand, these less powerful eddies are at a distance from the current and have less or no effect on the latter. In this case, the fiber distribution is modified only slightly or not at all.

With a wide baffle, the two eddies are also formed, but the distance separating them is sufficient so that the effects are distinct. There are two "pumping" effects of the current G and consequently two zones for increasing the density of the fibers.

The only purpose of these hypotheses is to provide a suitable explanation of the phenomena observed. It is not necessary to refer to this to satisfactorily implement the invention.

So that the modification effects of the induced currents on the fiber distribution are substantial, it is necessary that the baffle be placed in proximity to the attenuating gas currents. When the baffle is removed, the effect diminishes and becomes imperceptible very quickly. However, according to the invention it is possible to modulate the action of the baffle by varying its distance from the attenuating current.

An arrangement of this type is represented in FIG. 3. Here it will be seen that the baffle 15 is separated from the skirt of the attenuating apparatus.

Another means for modulating the baffle effect is to vary the surface opposing the passage of the induced air. With regard to the tests, it will be seen how the baffle effect evolves as a function of the dimensions.

In the embodiment represented in FIG. 3, the variation of the surface can be obtained particularly by using baffles of varying widths l.

It is also possible to use a series of elementary baffles of small dimension which, joined together, form a whole range of dimensions. One type of embodiment of this kind is represented in FIG. 6. On this figure, the baffle members 17 can be joined according to all serviceable combinations.

Still in the embodiment represented in FIG. 6, the members 17 are fastened to an edge of the guide apparatus. They are movable around a pivot axis supported by this edge.

The arrangement represented in FIG. 6, or any other similar embodiment, can be used with an automatic apparatus for pivoting the baffle elements. A detection device controlling the fiber density in the web or mat may be used to move the baffle elements by means of adequate circuits and mechanisms, the placement or the withdrawal of the baffle elements being effected as a function of instructions set to memory.

Other modes of embodiment than those represented, of course, are utilizable. For example, it is possible to place a series of movable baffle elements around axes which are not horizontal as in FIG. 6, but in a position adjacent the vertical. The pivoting of the baffle elements on their axes causes the latter to be either parallel to the induced currents and therefore offer little surface forming an obstacle to the passage of the gases, or perpendicular to the currents, or even in other intermediary positions between these two extremes.

In all the modes contemplated above, the baffle(s) form an obstacle to the circulation of the induced gases along the edges of the apparatus. In some cases, it can also be advantageous to introduce baffle elements at the ends of the gas current.

FIG. 7 presents a mode of utilization of a baffle 18 on one side of the apparatus at one end of the gas current.

The presence of a baffle in the position represented favors a surface effect. The attenuating gas current exiting from the skirt tends to run along the baffle. In this way, the position of the end of the gas layer carrying the fibers is well stabilized.

The use of the baffle on the side of the apparatus is particularly advantageous when, for whatever reason, for example, because of an accidental dissymmetry of the blower or in the surrounding conditioning the induced air, the gas layer carrying the fibers is offset toward one side. A situation of this kind is represented in FIG. 8*a* in which the gas layer is developed by the current lines indicated. On this figure, one wall of the guide apparatus is removed to show the trajectory of the gas. FIG. 8*b* represents the same assembly, however, with the addition of a baffle on the left side. The layer of fibers is displaced toward the side bearing the baffles.

It is possible to modulate the effect of the baffle placed on the side of the apparatus, as was seen above for those placed along the edges of the skirt and the guide apparatus. In particular, the dimensions, width and height, can be modified by using a series of elementary baffle elements. More particularly, when the desired displacement effect is particularly intense, the baffle can extend slightly over the side opening of the guide apparatus.

The following tests show in detail various types of implementation of the invention and the results that can be attained.

In all these tests, the apparatus and the conditions for forming the fibers remains unchanged, only the position and dimension of the baffles are modified.

A single bushing is used. The length of the bushing is about 350 mm and the reception is effected on a conveyor belt of 1600 mm width.

The results are graphically represented in FIGS. 9*a* to 9*d*. In all cases, a measurement is made of the fiber density on the conveyor belt. These measurements are made at regular intervals in a transverse direction on the belt. They are expressed in percentages over or under the average value for the entire width of the sample studied.

In other words, when, for example, on a given point the graph indicates a value of +20%, the density of the web at the point considered is 20% more than the average density calculated for the entire width of the web.

On the graphs, the axis of the abscissas represents the relative position of the various measurement points in the width of the web. The variations in density are indicated by ordinate. They also show the positions and dimensions of the baffles E. These latter are reproduced at the scale of the conveyor belt by a homothetic projection, in order to conveniently emphasize the effect of the baffle on the fiber web in the corresponding flow.

1ST EXAMPLE

Figure 9A:
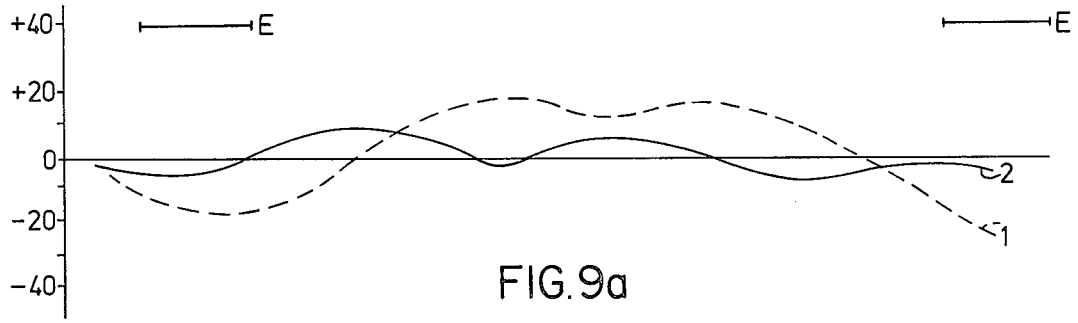

In FIG. 9*a*, the dotted curve represents the fiber distribution obtained in the absence of a baffle. It is ascertained that the product has a density clearly greater than the average in the vicinity of the center of the web and, on the other hand, a lesser density on the sides, particularly on the right side.

This fiber distribution taken on a sample is the resemblance of the instantaneous distribution. However, the reference curves made at the occasion of various other tests, discussed below, show the stability of this distribution. It is this type of lack of uniformity, maintained over relatively long periods of time, which is at least partially rectified by the invention.

In the case considered, an attempt to "rectify" the distribution consisted of placing two baffles, such as those represented in FIG. 3, each at one of the ends of the fiberizing apparatus. Each baffle is 25 mm wide.

The result of this modification imposed in the gas flow before the entry in the guide apparatus appears on the solid-line curve. The central portion which, in the absence of a baffle, receives an excess of fibers is practically reduced to the average value, just as the sides are better supplied.

The curve which, in a certain way, represents the quantity of fibers on a transversal cross section of the web is almost flat.

Additional improvements could be obtained by more finely varying the width of the baffles and by possibly introducing other baffles.

Figure 9B:
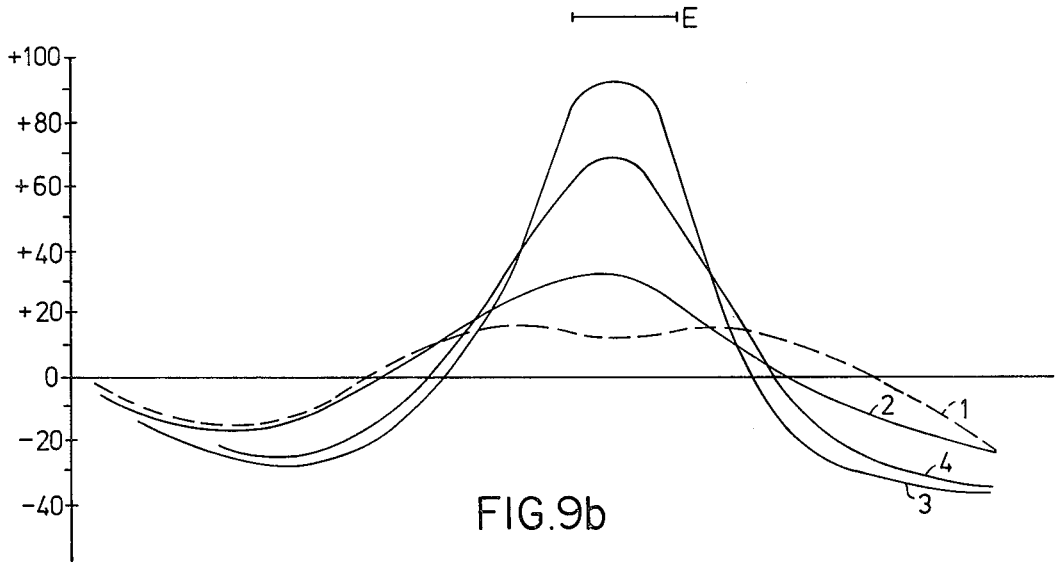
Figure 9C:
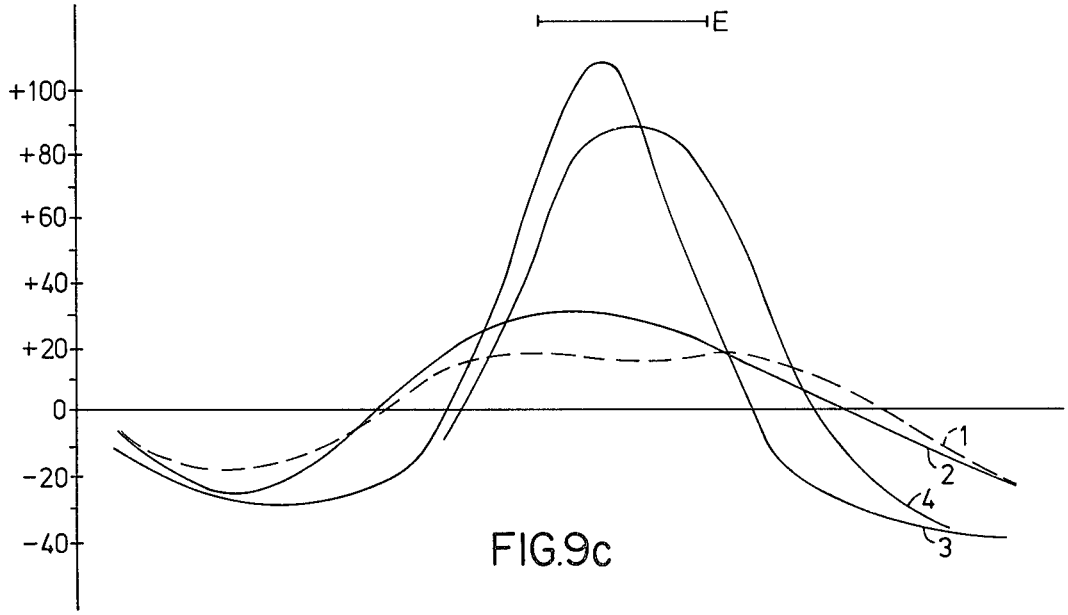
Figure 9D:
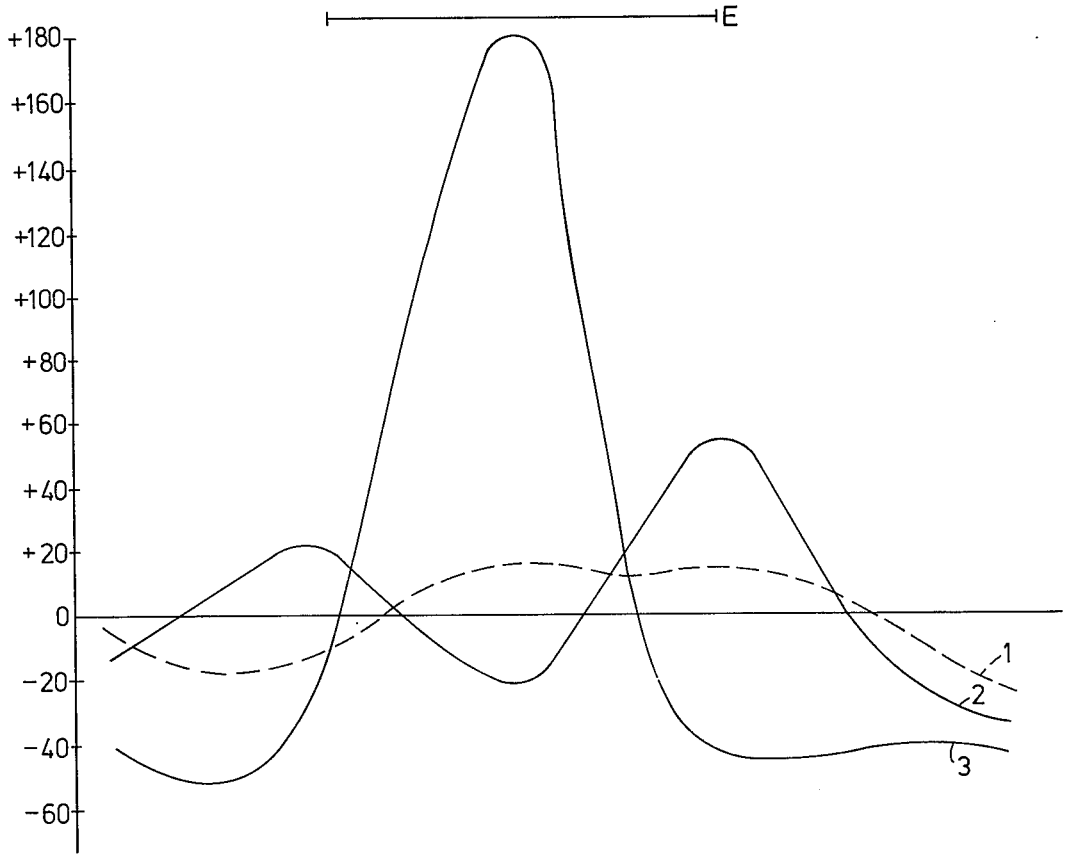

The purpose of the following tests, the results of which correspond to FIGS. 9*b*, 9*c* and 9*d*, is to show the influence of various factors and particularly the number, width and position of the baffles used. This does not concern correcting the density of the fiber web but seeing the possibilities for intervention offered by the means according to the invention. For this reason, the position of the baffle in these tests is not of great importance. It is (or they are) placed approximately in the median portion. The operative conditions and initial distribution of the fibers, that is, before the placement of the baffle(s), are identical in all cases.

Curve 1 serves as a reference. It represents the distribution obtained without a baffle.

2ND EXAMPLE

In FIG. 9*b*, curve 2 corresponds to the placement of a 25 mm baffle, curve 3 to that of two identical baffles placed symmetrically on both sides of the fiberizing apparatus.

As in the preceding example, an increase in fiber density in the wash from the baffle is ascertained. The effect which is substantial with a baffle is quite evident when the two baffles are facing one another. It seems likewise that the effect obtained in this case is more than the simple addition of the effect of two baffles taken individually. Be that as it may, this test shows a way of modulating the local modification of the fiber flow according to the invention.

In the test corresponding to curve 4, the two baffles are slightly withdrawn from the attenuating apparatus in the manner represented in FIG. 3 for the baffle 15. In this position the baffles are removed from the attenuating gas current and their action is reduced. The increase in fiber density remains substantial, however, and is lower than that corresponding to the two baffles arranged as at 14 of FIG. 3.

3RD EXAMPLE

The same tests as in Example 2 are renewed, however, this time by using baffles 40 mm wide. On FIG. 9*c*, as above, curve 2 corresponds to a single baffle and curve 3 to two baffles facing one another.

For a single baffle, the modification is similar to that ascertained with the 25 mm baffle. The increase in density is extended over a greater width.

The difference is more substantial with the utilization of two baffles. Not only is the expanse of the zone in which the increase in density is manifested slightly larger, but also the value of this growth is increased. This is especially clear for curve 4 corresponding to the baffles withdrawn from the attenuating apparatus.

For these dimensions, it is thus ascertained that the increase in the width of the baffle consequently causes an increased effect on the attenuating current and the fiber distribution.

4TH EXAMPLE

The tests corresponding to FIG. 9*d* illustrate that which was indicated above regarding the manner in which the baffles arranged according to the invention act on the induced currents.

In this case, the effects of baffles 90 mm wide were studied.

Curve 2 which corresponds to the presence of a single baffle indicates a diluted effect. The two growth peaks of fiber density correspond approximately to the edges of the baffle whereas, on the contrary, at the center the density is substantially reduced.

The presence of this wide baffle is equivalent to two separate baffles of small dimension, arranged at a distance from one another. The phenomenon observed is possibly explained by the hypothesis made above and which is illustrated in FIGS. 4 and 5. The aspiration of the fibers caused by the border effect is achieved at the ends not only by removing the fibers from the adjacent zones on each side of the baffle, but also by moving the fibers from the median zone located behind the baffle.

This result is compared with that obtained when two 90 mm baffles are used. This is illustrated by curve 3. In this case, the aspect of the preceding curves is found, namely, a unique, maximum density situated approximately the zone of the web corresponding to the region of the baffles. The maximum is quite pronounced by comparison to those preceding. Even if the border effects exist, they seem to be largely dominated by another mechanism.

If the hypothesis is adhered to of the dilution of the attenuating current by the induced gases, dilution which would locally prevent the presence of the baffle, an explanation of the results of this test can be attempted.

It can be supposed that the imbalance caused by the presence of the baffle on just one side of the gas current carrying the fibers is compensated by an accrued conveyance of induced air on the other side. In this hypothesis, only the edges of the baffle following the turbulent effects would produce an increase in the fiber density, the portion corresponding to the center of the baffle remaining practically unchanged. On the contrary, in the presence of two opposing baffles, the compensation would become impossible and the density peak would be all the more evident because the baffles cover a larger surface.

Whatever the exact mechanism, it is seen particularly in Example 2, but the same remark can be made for Example 3, that the effect of two baffles is always twice as great as the effect obtained with a single baffle.

The above tests show extreme modifications of the fiber distribution. In practice, the defects in distribution uniformity are less significant; and the use of small width baffles is sufficient to re-establish a good fiber distribution.

The industrial production lines generally include several associated fiber forming apparatus to form a single web or mat. The apparatus are aligned along the receiving member transverse to the latter. The web is thus formed by the superposition of fibers delivered from different fiberizing apparatus on the line. Typically, the installation can include 6 to 12 fiber forming apparatus of the type described above. To some extent, the multiplicity of the fiber layers statistically assures a better uniformity of the web. The defects arising from a fiber layer are proportionately less significant in the complete web. The implementation of the invention, however, remains very useful in further improving the quality of the product.

In the case of a complete line, the defects are detected after the deposit of all the fiber layers, for example, by means of $\beta$ sound rays. This is also an overall correction which is normally controlled. It is possible to only modify the fiber distribution on one of the apparatus without taking into account whether or not the irregularities discovered arise from this particular apparatus. It is also possible according to the invention to modify the regulation of several fiber forming apparatus on the production line.

The possibility of intervening on a single fiber forming apparatus is particularly advantageous in the event of an automatization of the correction of density defects. The complexity of the mechanical assemblies for assuring the movement of the elementary baffles can thus be reduced.

We claim:

1. Apparatus for making a fiber web from fibers which are gas attenuated from molten material, comprising a conveyor for the web, a device for delivering streams of molten material, attenuating means comprising means for subjecting said streams to an attenuating gas flow and having an outlet directed toward the conveyor, the conveyor being spaced from the attenuating means and having a perforate surface for receiving and accumulating the attenuated fibers to form the web, means in the path of gas flow from the attenuating means for distributing the attenuated fibers across the width of the perforate surface of the conveyor, the distributing means having an inlet spaced from the outlet of the attenuating means and providing an opening for induction of ambient gas into the periphery of the gas flow entering the distributing means, and baffle means between the attenuating means and the distributing means, the baffle means comprising a plurality of baffle elements separately mounted and distributed along a side of said opening and movable into and out of portions of said opening to selectively block individual portions of the opening for induction of ambient gas.

2. Apparatus as defined in claim 1 in which the baffle elements are mounted for individual and independent movement between positions in and out of the path of the ambient gas being induced.

3. Apparatus as defined in claim 1 in which the baffle elements are mounted on the distributing means.

4. Apparatus for making a fiber web from fibers which are gas attenuated from molten material, comprising a conveyor for the web, a bushing having a series of side-by-side orifices for delivering streams of molten material substantially in a common plane, attenuating means comprising means for subjecting said streams to an attenuating gas flow and having an elongated outlet paralleling said plane and directed toward the conveyor, the conveyor being spaced from the attenuating means and having a perforate surface moving in a direction transverse to said plane for receiving and accumulating the attenuated fibers to form the web, means in the path of gas flow from the attenuating means for distributing the attenuated fibers across the width of the perforate surface of the conveyor, the distributing means having an elongated inlet paralleling and spaced from the outlet of the attenuating means and providing for induction of ambient gas into the periphery of the gas flow entering the distributing means, the distributing means having an outlet of elongated shape extended transversely across the conveyor, and baffle means between the attenuating means and the distributing means, the baffle means comprising a plurality of baffle elements separately mounted and distributed along a side of said inlet and movable into and out of portions of said opening to selectively block individual portions of the opening for induction of ambient gas.

5. A method for making a fiber web from fibers which are attenuated from molten meterial, comprising developing a multiplicity of streams of the molten material, subjecting the streams to attenuation by delivering the streams into an attenuating gas flow directed toward a conveyor having a perforate surface for receiving and accumulating the attenuated fibers in the form of a web, entraining ambient gas into the attenuating gas flow in a region intermediate the attenuation of the fibers and the accumulation of the attenuated fibers on the perforate surface of the conveyor, spreading the combined attenuating and entrained flow over the width of the perforate surface of the conveyor, and regulating the uniformity of distribution of the fibers over the width of the conveyor by locally regulating the entrainment of ambient gas into the attenuating gas flow in selected localized zones of such entrainment.

6. A method as defined in claim 5 in which the regulation of the entrainment of ambient gas into the attenuating gas flow is effected by interpositioning a baffle element in a lozalized portion of the path of entrainment of the ambient gas.

7. A method for making a fiber web from fibers which are attenuated from molten material, comprising delivering from a bushing a plurality of side-by-side streams of molten material in a common plane, subjecting the streams to attenuation by delivering the streams into an attenuating gas flow of greater dimension in said common plane than transversely thereof and directed toward a conveyor travelling in a direction transverse to the common plane of the streams of molten material, the conveyor having a perforate surface for receiving and accumulating the attenuated fibers in the form of a web, entraining ambient gas into the attenuating gas flow in a region intermediate the attenuation of the fibers and the accumulation of the attenuated fibers on the perforate surface of the conveyor, spreading the combined attenuating and entrained flow over the width of the perforate surface of the conveyor, and regulating the uniformity of distribution of the fibers over the width of the conveyor by locally regulating the entrainment of ambient gas into the attenuating gas flow in selected localized zones along said common plane.

* * * * *